US005570986A

United States Patent [19]

Hasegawa et al.

[11] Patent Number: 5,570,986

[45] Date of Patent: Nov. 5, 1996

[54] CARGO CONTAINER TRANSFER SYSTEM FOR CRANES

[75] Inventors: Shuji Hasegawa; Masamitsu Enoki, both of San Mateo, Calif.

[73] Assignee: Paceco Corp., San Mateo, Calif.

[21] Appl. No.: 177,113

[22] Filed: Jan. 3, 1994

[51] Int. Cl.[6] ..... B66C 5/02

[52] U.S. Cl. ..... 414/140.3; 212/272; 212/325

[58] Field of Search ..... 212/147, 210, 212/218, 219, 272, 324, 325, 326; 414/139.9, 140.3

[56] References Cited

U.S. PATENT DOCUMENTS

| | | | |
|---|---|---|---|
| 3,630,390 | 12/1971 | Tax et al. | 212/210 |
| 3,952,891 | 4/1976 | Terayama et al. | 414/139.9 |
| 4,049,132 | 9/1977 | Stromback | 212/218 |
| 4,106,639 | 8/1978 | Montgomery et al. | 212/219 |
| 4,172,685 | 10/1979 | Nabeshima et al. | 212/219 |
| 4,293,077 | 10/1981 | Makino | 212/147 |
| 5,152,408 | 10/1992 | Tax et al. | 212/161 |

FOREIGN PATENT DOCUMENTS

| | | | |
|---|---|---|---|
| 294121 | 11/1989 | Japan | 414/140.3 |
| 317995 | 12/1989 | Japan | 212/210 |
| 313300 | 12/1989 | Japan | 212/219 |
| 789363 | 12/1980 | U.S.S.R. | 414/140.3 |

*Primary Examiner*—Thomas J. Brahan
*Attorney, Agent, or Firm*—Bruce & McCoy

[57] ABSTRACT

A method and apparatus for cargo container transfer in a cargo container handling gantry crane for reducing container handling cycle times.

2 Claims, 3 Drawing Sheets

CARGO CONTAINER TRANSFER SYSTEM FOR CRANES

BACKGROUND OF THE INVENTION

1. Field of the Invention

The present invention relates to improved apparatus and novel methods of operation for cargo container handling cranes having a horizontal gantry supported at an elevated location above the cargo container pickup and deposition areas. More particularly, the present invention relates to the apparatus and method for reducing cargo container handling and transfer cycle times by employing positive residual sway arrest and automatic container transfer in a cargo container handling crane which transports containers horizontally along the gantry of the crane.

A computer controlled shuttle is utilized by the present invention whereby cargo containers can be simultaneously lifted and lowered independently at opposite ends of the crane gantry while concurrently containers are transported along the gantry by the shuttle. Residual sway in the container pickup apparatus during lowering is arrested by passing it through a guide chute near the end of the lowering cycle.

2. Description of the Prior Art

The handling and protection of cargo and material during its transportation has been greatly facilitated by the advent of containerization many years ago. Rail mounted dockside gantry cranes having retractable booms have now been long accepted as the standard in the industry for loading and unloading containerized cargo and fungible bulk materials. The containers are moved by the cranes between waterborne vessels and dockside transportation equipment.

When a cargo container transport ship is berthed alongside a dock, a gantry crane is moved along the dock parallel to the ship to a position where a retractable boom can be extended across the beam of the ship above the ship's cells which are the cargo container carrying area. The retractable boom in its operating position extends horizontally outboard from the crane's superstructure and, in its retracted position, clears the superstructure of any ship berthed alongside the dock adjacent to the crane. Containers can be transported along the gantry of the crane between the dockside pickup and deposition area and any storage position located within the beam of a berthed ship in its holds or on its deck.

In the particular form of a gantry crane to which the present invention pertains, the purpose is to move cargo containers a specific horizontal distance from a pickup area to a deposition area. In each operation, in the most usual situation, the pickup area is either a dockside location where a container is picked off of a flatbed trailer or transport truck or railroad car, and moved outboard by the crane and lowered into a shipboard cargo container cell, or the reverse, wherein a container is lifted from a cell onboard ship and moved to a dockside storage area or a truck, trailer or railroad car.

The gantry portion of the cargo container handling crane of the preferred embodiment of the present invention includes the retractable boom and a dockside portion and a rear extension of said boom supported by the crane superstructure. However, it is applicable to any crane wherein containers are moved along a gantry from a pickup position to a deposition area. Trolleys run along the gantry and suspend cargo container lifting spreaders from fleet-through wire rope reeving for attaching to and picking up cargo containers.

In a transfer cycle by a crane, the container must first be picked up, then lifted vertically, moved horizontally, and then lowered to its deposition area. During a portion of the move, vertical and horizontal movement of the container can occur simultaneously. However, for each transfer cycle, the crane must raise or lower a container a specific distance to clear the side of a ship, and a round trip transfer cycle takes a substantial period of time to handle one container.

In addition to the transfer cycle time required to pickup, lift, move, lower, and deposit the container, there is also a delay at each end of the cycle if sway or pendulum movement is induced into the load by virtue of the starting and stopping of the horizontal movement of the container along the gantry. It takes additional time to abate the sway and to position the container by selectively controlling the forward and reverse movement of the trolley.

A more recent development in the field of cargo container handling is the development of the hatch coverless container ships which unfortunately has increased the container transfer cycle time in the prior art gantry cranes. These ships were developed to reduce lashing work or container tie down time for containers stacked on the open deck of the ship. This development provides cell guides which project upwards from the deck of the ship and which therefore require every vertical movement of a container to clear not only the side of the ship but the tops of all the upward projecting cell guides as well which previously did not extend above the ship's deck.

Therefore, in comparison, when loading and unloading the old type of ship, the container did not always have to be fully lifted a specified height above the deck of the ship. It was only necessary to clear the deck of the ship until containers began to be stacked on top of the deck. At that point, it was still necessary only to lift containers over those already stacked on the deck although when a ship is properly loaded and unloaded, it is accomplished in a way in which the outboard containers are placed on the ship first and unloaded last so that subsequent containers do not have to be lifted over more than the minimum height of on-deck containers than is necessary.

Therefore, the container handling productivity for hatch coverless ships is considerably lower in comparison with conventional container ships because the handling pass or transfer cycle on the latter is substantially shorter until stacked containers on the ship gradually increase the time of the handling pass or transfer cycle.

One method of improving the speed of operation of a crane is to provide a twin lift crane in which two containers are handled at the same time by the crane. However, this requires nearly a complete duplication of machinery: at least twin booms and two-thirds the superstructure of two cranes, but the crane can handle two containers simultaneously by the same number of operators.

The present invention overcomes the limitations of the prior art by providing a single gantry crane which lowers the cycle transfer time by handling several containers simultaneously and by arresting residual sway of the cargo container lifting apparatus. It includes new and novel apparatus and methods of operation. A pair of trolleys on the gantry of the crane are dedicated to lifting and lowering the load and do not horizontally traverse with it. An automatic shuttle is provided which traverses the gantry between the two lifting and lowering trolleys and horizontally transports containers between the trolleys. This allows three containers to be handled almost simultaneously, one being lifted, one being transported horizontally, and one being lowered. In addition, the positioning of the lifting spreader for the purpose of picking up a container or for depositing it underneath the superstructure of the crane is aided by a container guide chute which arrests the residual sway in the lifting spreader at the shoreside end of the crane.

SUMMARY OF THE INVENTION

The present invention is a container transfer system for a cargo container handling crane having a horizontal gantry supported at an elevated location above container pickup and deposition areas. It comprises a pair of movable means disposed at opposite ends of the gantry and formed for movement therealong. Each of the means has a cargo container lifting spreader suspended therefrom for lifting and lowering cargo containers from and to the pickup and deposition areas. An automatic shuttle is suspended from the gantry and formed for movement between the lifting spreaders. The shuttle is formed for receiving cargo containers from the lifting spreaders and transporting the containers from either of said spreaders to the other irrespective of their positioning along said gantry.

The present invention also includes the method of operation of a cargo container handling crane having a horizontal gantry supported at an elevated location above the container pickup and deposition areas. It comprises lifting and lowering cargo containers from and to the pickup and deposition areas independently and simultaneously at locations proximate to opposite ends of the gantry, and transporting the containers between the two locations on an automatic shuttle whereby each cargo container is first lifted from a pickup area at one end of said gantry, transported along the gantry by the automated shuttle, and lowered to a deposition area at the other end of the gantry while other containers are concurrently being lifted, lowered and transported.

The method of the invention also includes arresting residual sway in loads transported by a lifting spreader by providing a moveable lifting spreader guide chute disposed below the gantry and formed for arresting sway of lifting spreaders lowered therethrough. The chute is accurately locatable above the container pickup and deposition areas and permits the relatively free passage of lifting spreaders which are raised therethrough.

OBJECTS OF THE INVENTION

It is therefore an important object of the present invention to provide a new and novel method and apparatus for reducing the cycle time of the operation of a cargo container handling crane.

It is another object of the present invention to provide a method and apparatus for increasing the handling capacity of a cargo container handling crane.

It is a further object of the present invention to provide a method and apparatus for implementation of computer control of a substantial portion of each cycle of a cargo container handling operation.

It is still another object of the present invention to provide a cargo container handling gantry crane which lifts and lowers containers independently and simultaneously at locations proximate to opposite ends of the gantry while concurrently transporting containers between those locations.

And it is yet a further object of the present invention to arrest residual sway in a lowered cargo container by passing it through a guide chute.

Other objects and advantages of the present invention will become apparent when the apparatus and methods of the present invention is considered in conjunction with the accompanying drawings.

DESCRIPTION OF THE PREFERRED EMBODIMENT

Reference is made to the drawings for a description of the preferred embodiment of the present invention and the prior art wherein like reference numbers represent like elements on corresponding views.

Figure 1:
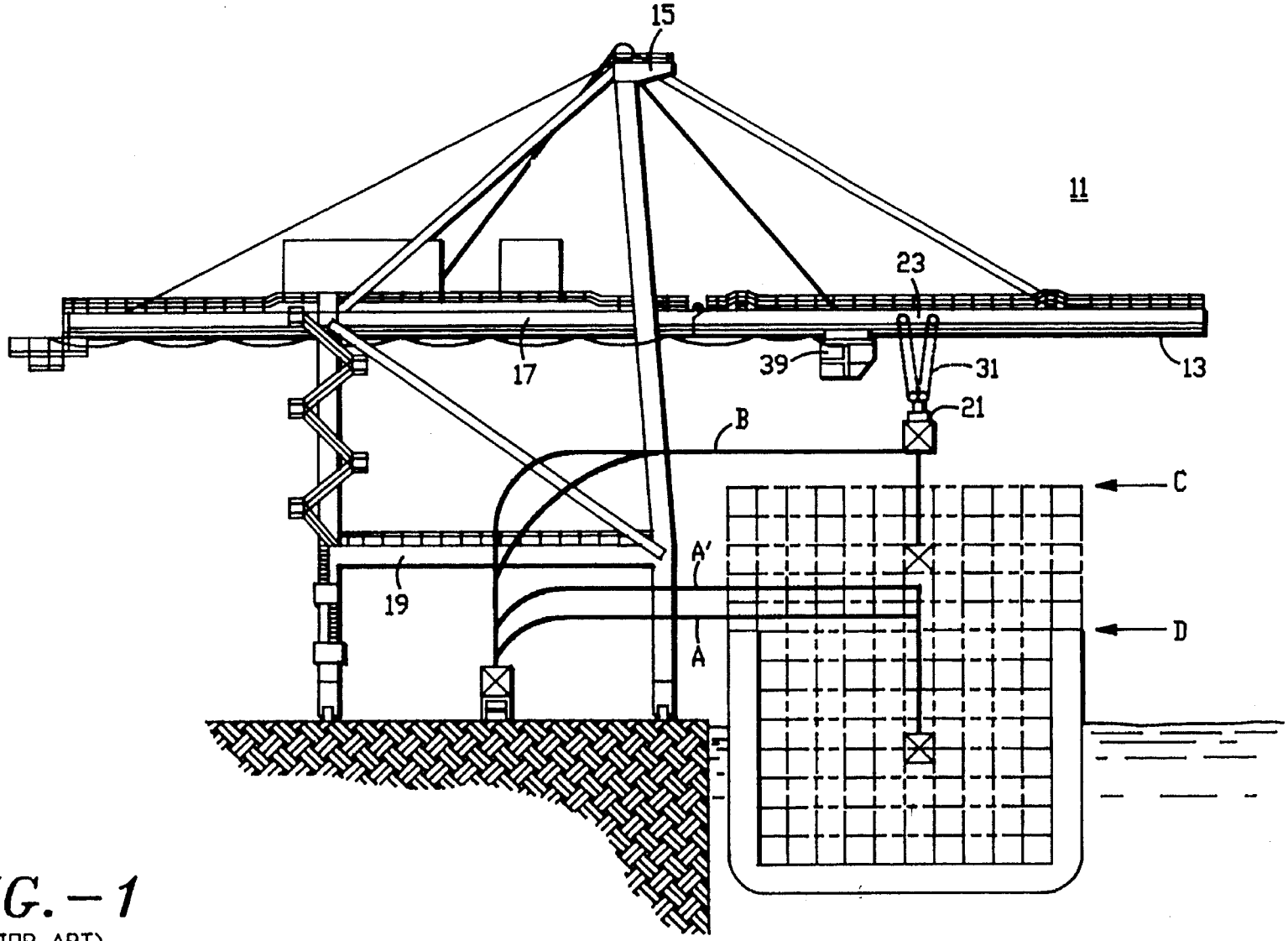
FIG. — 1 (PRIOR ART)
FIG. 1 is a side elevation of a prior art cargo container handling gantry crane illustrating the loading of both standard and hatch coverless container ships shown in partial cross-section.

Reference is made to FIG. 1 of the drawings for an illustration of the prior art. Thereshown is a cargo container handling gantry crane 11 with a retractable boom 13 which projects outboard from the superstructure 15 of the crane over the beam of a ship berthed alongside the dock. The boom in the illustrated embodiment folds upward to project just short of vertically whereby the superstructure of a ship can pass alongside the dock and not interfere with the boom when it is raised. In other types of gantry cranes, where height restrictions limit raising the boom, typically in ports located near airports, the gantry can slide horizontally outboard over a ship or partially fold when it is raised.

The gantry 17 of the crane extends rearward of the retractable boom in a portion which resides within the superstructure of the crane, and projects further rearward out over a storage area on the landside end of the crane. Railroad tracks and roadways pass underneath the superstructure and rear projection of the crane for the delivery and removal of cargo containers thereunder by transportation equipment.

In FIG. 1, the hoist, transfer, and lowering cycles of a cargo container between shoreside and ship pickup and deposition locations are represented by the black solid lines which show the container movement paths. For a standard container ship, wherein the containers need be lifted only high enough to clear the side of the ship, the raise and lowering cycles are greatly reduced as are illustrated by container transfer paths A and A'. This occurs because the container cells are all disposed within the hold of a ship illustrated by the dashed lines. Container path A represents movement of containers into the ship holds. Once the ship has been filled, then containers are stacked on top of the deck of the ship and lashed thereto. The deck level of the ship is designated by D. During this portion of the loading sequence, the containers must be lifted only high enough to clear any on-deck containers represented by container path A' where one level of containers are lashed on deck.

The hatch coverless type of ship is also illustrated by this same illustration by showing the dashed lines of the cells extending to C above the ship's deck. Thus, for the deposition of each container on a hatch coverless ship, it must be raised to clear all of the cell structure above the deck of the ship for each container transfer cycle. The container cycle path and movement are represented for this type of ship by the solid line B. While the time needed to lash the containers to the deck is greatly reduced by the hatch coverless ship, the cycle time for container transfer is increased for each container because of the additional specific lifting and lowering distance which must be covered during each cycle to clear the cell structures on top of the deck of the ship.

Figure 2:
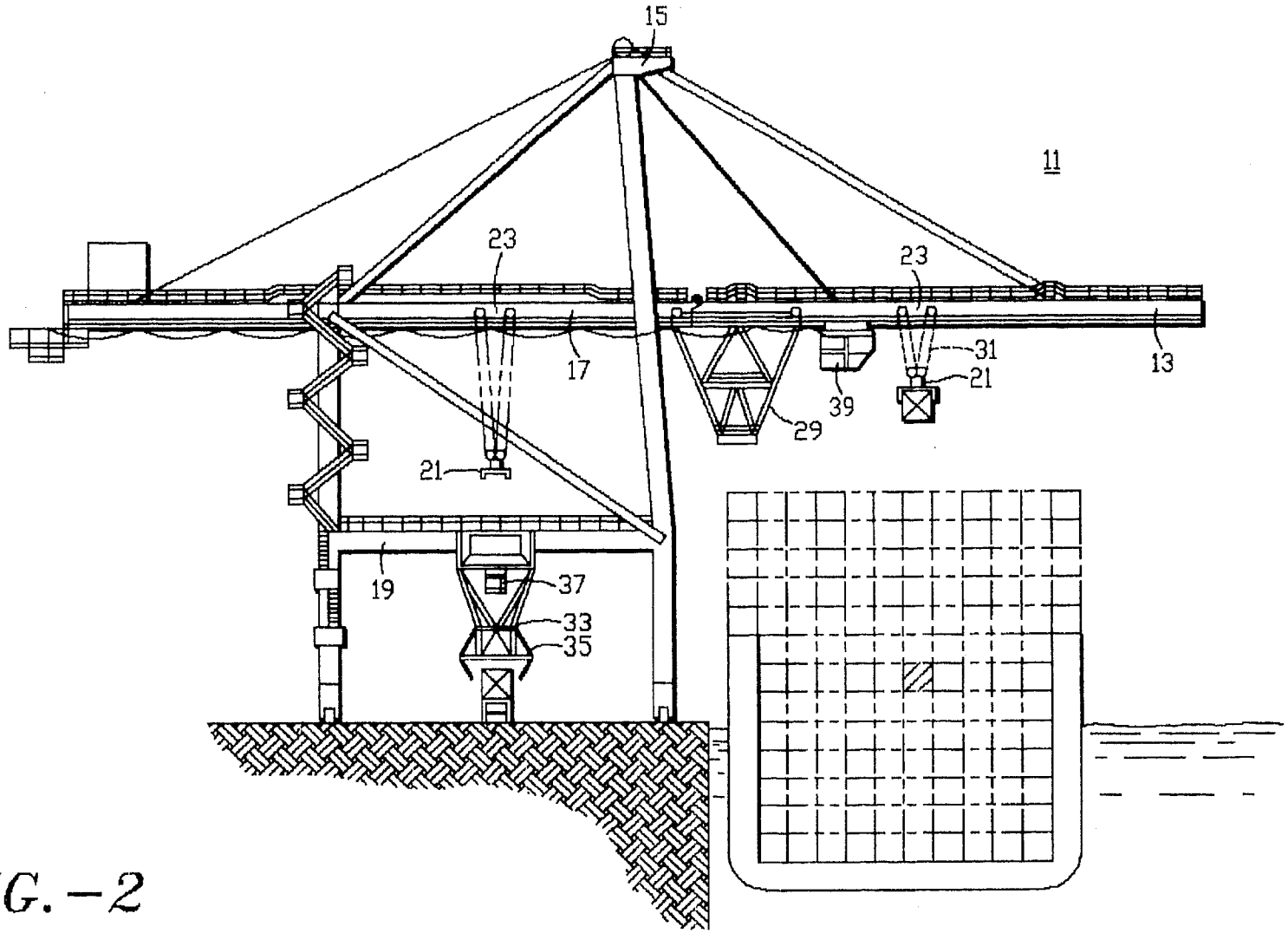
FIG. 2 is a side elevation of a cargo container handling gantry crane of the present invention.
Figure 3:
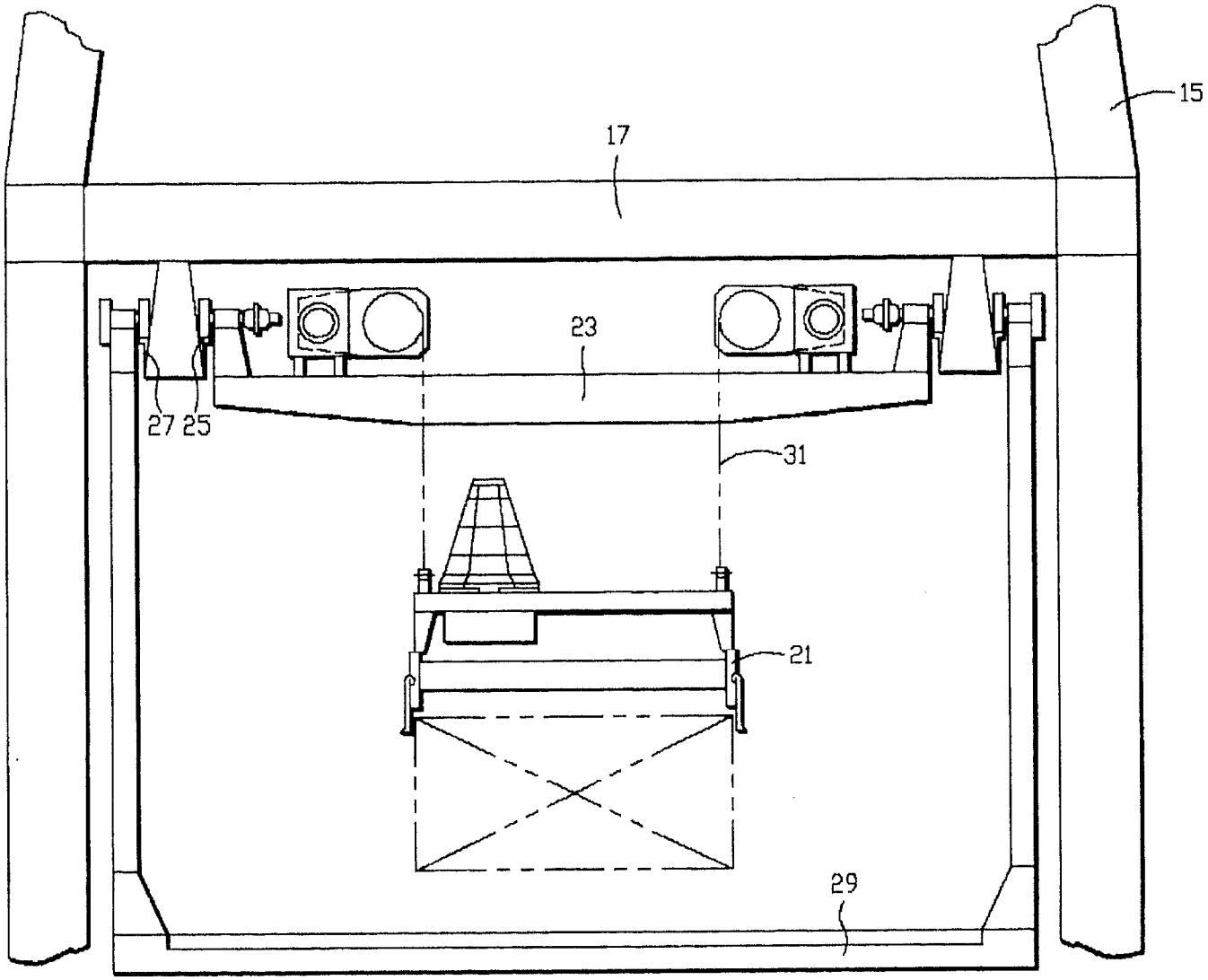
FIG. 3 is a cross-section view of the gantry of a cargo container handling crane of the present invention illustrating a trolley and lifting spreader combination along with the automatic shuttle.

Reference is made to FIGS. 2 and 3 of the drawings which show the configuration of the preferred embodiment of the apparatus of the present invention which reduces cargo container transfer cycle time. Thereshown is a cargo container handling crane 11 very similar to the prior art gantry crane of FIG. 1. It has a horizontal gantry 17 supported at an elevation above container pickup and deposition areas. The gantry is designed to project outboard over a ship moored alongside a dock and the crane superstructure 15 is designed to straddle the dockside cargo container pickup and deposition from and to shoreside transportation. The crane superstructure also includes horizontal crossbracing 19 disposed below the gantry.

A pair of movable means are disposed at opposite ends of the gantry and are formed for movement therealong. Each of the means has a cargo container lifting spreader 21 suspended therefrom for attaching to the container whereby the movable means can be located at variable locations on the gantry and lift and lower cargo containers from and to pickup and deposition areas located below the gantry. In the typical case, the movable means are trolleys 23 which are supported on rails 25, 27 that are secured to the gantry 17.

The container transfer system of the present invention includes two pairs of collinear different gauge tracks 25, 27 mounted on the gantry of the crane. A pair of trolleys are supported on the first pair of the tracks 25 at opposite ends of the gantry. The trolleys are formed for movement along the tracks on the gantry. In the preferred embodiment, the trolleys are mounted on the narrower pair of the collinear different gauge tracks.

An automatic shuttle 29 is suspended from the gantry 17 and supported on the second pair of collinear tracks 27; the wider gauge pair of tracks. The shuttle is formed for movement along the gantry between the trolleys 23 and for receiving cargo containers from the lifting spreaders 21. The shuttle automatically transports the containers from either trolley and spreader combination to the other. The trolleys can be disposed at variable positions on the gantry and the movement of the shuttle between the trolleys at the various locations is computer controlled.

Standard computer control of the trolleys utilizes an encoder which counts revolutions of the drive motors or wire rope drums which operate the drive machinery and hoist ropes 31. An optical pulse generator is created by passing an optical beam through a perforated disk which is secured to the drive motors or wire rope drums. An optical detector senses the breaks in the optical beam caused by the disk, and they are counted by the computer whereby the exact position of a cargo container, both vertically and horizontally, with respect to the gantry, and the relative movement with respect thereto, can be accurately determined, and thereby the transfer of the containers accurately controlled. This is fundamental technology in cargo container handling by a crane, and once a container has been attached to a container or released, movement of the trolley and the spreader is computer controlled.

However, operator control is required at each end of the cycle for two purposes: attachment of a lifting spreader to a container, and positioning of a container for deposition. The operator must accurately locate the spreader above a container for pickup at the landside end of the crane, from a trailer, truck, or railroad car, or from a stack of containers in a storage area or freestanding on the deck of a ship. The operator must also accurately locate a spreader carrying a container for lowering into a ship's cell or onto a truck, trailer, or railroad car, or onto a stack of containers in a storage area or freestanding on the deck of a ship.

To assist in locating a lifting spreader 21, either unloaded or carrying a container, the present invention contemplates providing a method and apparatus for arresting residual sway in the spreader by providing a movable lifting spreader guide chute 33 disposed below the gantry 17. It is formed for arresting the sway of lifting spreaders 21 being lowered therethrough. The chute can be accurately located above the container pickup and deposition areas. The container guide chute is also formed to permit the relatively free passage of lifting spreaders that are raised therethrough. The lifting spreader guide chute is provided at at least one end of the gantry proximate the shoreside pickup and deposition areas located under the crane's superstructure.

The container guide chute has openable and closable guides 35 for alternately enlarging and constricting the pass through opening of the chute. This, in turn, unimpedes or controls the movement of the lifting spreaders therethrough. The openable and closable guides are disposed at the lower end of the guide chute for allowing the relatively free passage of a lifting spread therethrough when they are in the open condition and the lifting spreader is moving upward through the chute. In their simplest form, they are simply panels pivoted at their upper ends to the guide chute which are opened and closed by hydraulic cylinders or electric motors. In practice, they are simply guide bars which open and close. The guides can be closed for arresting the residual sway of a descending lifting spreader by restricting the lateral movement of the spreader in the chute. This arrangement arrests residual sway in a suspended container after lowering and assists the accurate placement of the load on the deposition target.

In practice, the guide chute 33 serves an additional function as a spreader stopper: a safety feature. Under current regulations, a chassis operator, such as a truck driver, cannot move a truck or container chassis under a free-hanging lifting spreader suspended by wire rope. With the guide chute of the present invention, means are provided in the guide chute to grasp a container and spreader combination, or the empty spreader alone, and support it. The guides 35 can be closed to grasp a spreader for this purpose. In this manner, a chassis operator may drive or move the chassis into receiving position under the supported load. Then, the load can be released and placed on the chassis saving time and eliminating chassis operator procedures.

In the preferred embodiment of the present invention, the lifting spreader guide chute 33 is supported by the horizontal crossbracing 19 of the crane's superstructure and is formed for movement therealong to permit the chute to be disposed over variable locations in the dockside container pickup and deposition areas.

An operator's cab 37 is disposed proximate the lifting spreader guide chute 33 and is formed to move therewith as the chute is moved to different locations along the crossbracing 19. This permits the operator to be continually located close to the container pickup area where the lifting spreader 21 must be attached to a cargo container located on shoreside transportation or in a storage area.

A second operator's cab 39 is suspended from the outboard or shipside trolley 23 and travels with it as it moves along the gantry so that the operator is located above the ship's cells that containers must be lowered into or removed from.

The automatic shuttle 29 is suspended from the gantry in a manner to allow the trolleys, and a cargo container secured to a lifting spreader 21 suspended from either of said trolleys 23, to pass through the shuttle when the spreader carrying a container is fully raised. This capability permits either trolley to deposit a container in the shuttle after it has been lifted above the shuttle floor and the shuttle moved under the trolley. The shuttle can be motor driven but most practically is wire rope controlled for compatibility with computer control of the trolleys, and C.G. considerations of the shuttle.

The movement of the shuttle 29 is computer controlled in the same way as the trolleys to permit movement of a cargo container disposed thereon from one trolley to the other irrespective of the location of the trolleys on the gantry 17, and, after the container has been removed therefrom, to return the shuttle to the other trolley. The computer also controls the lifting and lowering of the loads by the movable trolleys onto and off of the shuttle once they have been picked up. An automatic release and pickup onto and off of the shuttle is also computer controlled and utilizes the same sensing system presently in use for determining whether the twistlocks on the lifting spreaders are engaged or disengaged to or from a cargo container. The operators control the placement and attachment of the lifting spreader onto a cargo container to be lifted or the lowering of a container into a ship's cell guide, or placement onto shoreside transportation, at the lower end of the lowering cycle.

The present invention also includes the method of operation of any cargo container handling crane having a horizontal gantry supported at an elevated location above the container deposition and pickup areas. It includes the steps of lifting and lowering cargo containers simultaneously at opposite ends of the gantry and transporting cargo containers from one end of said gantry to the other on an automatic shuttle while concurrently lifting and lowering containers at the ends of the gantry. As a result, each cargo container is first lifted from a pickup area at one end of the gantry and transported along the gantry by an automated shuttle and then lowered to a deposition area at the other end of the gantry while other containers are concurrently being lifted, lowered and transported.

The containers are lifted and lowered independently at the ends of the gantry by a pair of trolleys mounted on the gantry having lifting spreaders suspended from the trolleys. The containers are deposited on and removed from the shuttle by the lifting spreaders. The method specifically includes providing a pair of trolleys at opposite ends of the gantry and providing a shuttle suspended from the gantry and formed for receiving cargo containers from either of said trolley and lifting spreader combinations and then automatically transporting the container which has been deposited in the shuttle to the other of the trolleys. The process can be reversed to move containers in the other direction.

The method of the present invention also includes the elimination of residual sway in a suspended lifting spreader at one end of the gantry during the lowering of the lifting spreader by passing the spreader through a movable spreader guide chute located above the respected pickup or deposition area.

Thus, it will be apparent from the foregoing description of the invention in its preferred form that it will fulfill all the objects and advantages attributable thereto. While the apparatus and method of the present invention have been illustrated and described in considerable detail, the invention is not to be limited to such details as have been set forth except as may be necessitated by the appended claims.

We claim:

1. A container transfer system for a cargo container handling crane having a horizontal gantry supported by a crane superstructure at an elevated location above the container pickup and deposition areas, said gantry including two pairs of collinear different gauge tracks mounted on the longitudinal axis thereof, said system comprising a pair of trolleys supported on the narrower pair of said tracks at opposite ends thereof and formed for movement therealong, said trolleys each having a cargo container lifting spreader suspended therefrom, an automatic shuffle suspended from said gantry and supported on the wider pair of said tracks and formed for reciprocal movement between said trolleys, said shuttle also formed for receiving cargo containers from said lifting spreaders in midair and automatically transporting said containers from either trolley and spreader combination to the other, and at least one moveable lifting spreader guide chute forming a container pass through opening suspended from said crane superstructure and disposed below said gantry and being accurately locatable above said container deposition areas, the cargo container lifting spreader suspended from that trolley of said pair of trolleys, which is located at the end of said tracks disposed over said guide chute, being formed for lowering cargo containers through said guide chute when depositing said containers, said guide chute having sloped side guide walls for restricting the pass through opening of said chute and the relative movement of lifting spreaders therethrough whereby said chute is formed for arresting the residual sway of lifting spreaders being lowered therethrough by restricting the pendulum sway of a lifting spreader between the converging sloped side guide walls until the sway of the descending spreader is restricted within said passthrough opening and permitting the relatively free passage of lifting spreaders being raised therethrough.

2. A container transfer system for a dockside cargo container handling crane having a horizontal gantry supported at an elevated location above the ground by a crane superstructure, said gantry being designed to project outboard over a ship moored alongside a dock and said superstructure being designed to straddle the dockside cargo container pickup and deposition area, said superstructure including horizontal cross-bracing disposed below said gantry, said system comprising a lifting spreader guide chute forming a container pass through opening supported by said horizontal cross-bracing and formed for movement therealong to permit said chute to be disposed over variable locations in said dockside container deposition area, said guide chute having sloped side guide walls for restricting the passthrough opening of said chute and the relative movement of lifting spreaders being lowered therethrough, a landside trolley supported by said gantry and formed for movement therealong and having a first cargo container lifting spreader suspended therefrom, said spreader being formed to lower cargo containers through said chute when said chute is disposed below said trolley and said spreader is raised and lowered from said landside trolley, said chute being formed for arresting the residual sway of lifting spreaders being lowered therethrough by restricting the pendulum sway of a lifting spreader between the converging sloped side guide walls until the sway of the descending spreader is restricted within said passthrough opening and for permitting the relatively free passage of lifting spreaders being raised therethrough, a shipside trolley supported by said gantry and formed for movement therealong and having a second cargo container lifting spreader suspended therefrom, said spreader being arranged to fit into shipboard container cells when raised and lowered from said shipside trolley and when said trolley 1s disposed above and aligned with a cell, and an automatic shuffle suspended from said gantry and formed for movement therealong and for receiving cargo containers from said first and second lifting spreaders In midair and transporting said containers from either trolley and spreader combination to the other.

* * * * *